US006349679B1

(12) United States Patent
Mashimo et al.

(10) Patent No.: US 6,349,679 B1
(45) Date of Patent: Feb. 26, 2002

(54) CIRCULARLY-CURVED PISTON ENGINE

(75) Inventors: Hayami Mashimo, Saitama; Saichi Ito, Ibaragi, both of (JP)

(73) Assignees: Nihon Software Approach Co., Ltd., Urawa; Ito Tekkosho Co., Ltd.; Ishihara Mokuzai Co., Ltd., both of Koga; Masaaki Mimura, Musashino, all of (JP)

( * ) Notice: Subject to any disclaimer, the term of this patent is extended or adjusted under 35 U.S.C. 154(b) by 0 days.

(21) Appl. No.: 09/431,777

(22) Filed: Nov. 2, 1999

(30) Foreign Application Priority Data

Jun. 16, 1999 (JP) ..... 11-170146

(51) Int. Cl.[7] ..... F02B 53/00

(52) U.S. Cl. ..... 123/18 R; 92/120; 92/152; 92/158; 184/6.5

(58) Field of Search ..... 123/18 R; 92/120, 92/152, 158; 184/6.5

(56) References Cited

U.S. PATENT DOCUMENTS 1,737,082 A * 11/1929 Gough ..... 123/18 R
2,201,525 A * 5/1940 Fedden et al. ..... 184/6.5
3,315,648 A * 4/1967 Castillo ..... 123/18 R
5,152,254 A * 10/1992 Sakita ..... 123/18 R
5,474,036 A * 12/1995 Hansen et al. ..... 123/80 BB

FOREIGN PATENT DOCUMENTS

DE 2639450 B1 * 3/1978 ..... 123/18 R
DE 3020499 * 12/1981 ..... 123/18 R
GB 19211 * 8/1897 ..... 123/18 R
JP 411294258 A * 10/1999

* cited by examiner

*Primary Examiner*—Thomas Denion
*Assistant Examiner*—Thai Ba Trieu

(57) ABSTRACT

This engine is substantially free from any vibration and noise, small in friction loss, improved in mechanical efficiency to a considerable extent, compact and lightweight, and applicable to a reciprocating piston engine. The engine comprises: curved cylinders each assuming a circular shape in cross section; curved pistons (1, 1*a*) each fitting and reciprocating within the cylinder; a rotor (2) carrying the pistons (1, 1*a*) to keep them in balance and to have them be rockable about the center of the rotor (2), wherein the rotor (2) is provided with connecting rods (6, 6*a*) to impart half a rocking power of the rotor (2) to each of crank shafts (10, 10*a*) each of which converts the half of the rocking power to a piece of torque on its axis of rotation; a gear mechanism for receiving the pieces of torque to combine them into an output power; and, an output shaft connected with the gear mechanism for receiving and out-putting the output power.

15 Claims, 10 Drawing Sheets

CIRCULARLY-CURVED PISTON ENGINE

BACKGROUND OF THE INVENTION

1. Field of the Invention

The present invention relates to a circularly-curved piston engine, and more particularly to a circularly-curved piston engine provided with both a circularly-curved cylinder and a cylindrical piston fitting and reciprocating within the cylinder. The piston engine of the present invention is applicable to any other reciprocating engine or mechanism such as reciprocating internal combustion engines, reciprocating external combustion engines, reciprocating compressors and like machines.

2. Description of the Related Art

In a so-called reciprocating internal combustion engine typical of the piston engines, there is employed a slider-crank mechanism comprising: a cylinder; a cylindrical piston which linearly reciprocates within the cylinder; a connecting rod which has one of its opposite ends rotatably connected with the cylindrical piston and the other rotatably connected with a crank shaft. In this reciprocating engine, the linear reciprocating motion of the cylindrical piston is converted into rotary, or turning motion through the connecting rod.

In the above-mentioned conventional piston engine, when the piston moves up and down within the cylinder, the connecting rod is periodically tilted from a direction of up-and-down motion of the piston. Due to the presence of this periodic tilt of the connecting rod, the piston is subjected to periodic side pressures which cause the piston to hit and rub the cylinder, i.e., cause a so-called "piston slap" forming a major factor in vibrations, noises and friction losses in the piston engine.

Further, unbalance mass or inertia in each of the pistons, piston pins, connecting rods and like reciprocating components of the piston engine causes the engine to vibrate and to issue noises.

In each of cylinders of a multiple-cylinder type reciprocating internal combustion engine, the complete cycle of events requires four piston strokes (i.e., combustion, exhaust, intake, and compression), which cause variation in output torque of the engine, torsional vibrations of the crank shaft and noises. Further, due to the presence of couples of forces in inertia or mass as to the individual engine components such as the cylindrical pistons, piston pins, connecting rods, and like moving components, the crank shaft further suffers from additional vibrations caused by the above couples of forces in inertia or mass and also suffers from additional noises caused thereby.

These disadvantages appearing in the reciprocating internal combustion engines appear also in the reciprocating external combustion engines, reciprocating compressors, and various types of actuators.

SUMMARY OF THE INVENTION

It is an object of the present invention to provide a circularly-curved piston engine, which is free from the above-mentioned disadvantages inherent in the conventional reciprocating piston engine, i.e., substantially free from any vibrations and noises, small in friction loss, improved in machine efficiency, and is compact and lightweight.

The above object of the present invention is accomplished by providing:

A circularly-curved piston engine comprising:

a plurality of circularly-curved cylinders each assuming a circular shape in cross section;

a plurality of circularly-curved cylindrical pistons each fitting and reciprocating within each of the cylinders;

a rotor carrying the pistons to keep them in balance and to have them be rockable about the center of the rotor along their orbits relative to the cylinders, wherein the rotor is provided with a pair of connecting rods to impart half a rocking power of the rotor to each of a pair of crank shafts each of which converts the half of the rocking power to a piece of torque on its axis of rotation;

a gear mechanism for receiving a pair of these pieces of torque to combine them into an output power; and an output shaft connected with the gear mechanism for receiving and out-putting the output power.

In the piston engine of the present invention having the above construction, the circularly-curved cylindrical piston is free from any side pressure during its reciprocating or rocking motion. Consequently, the piston engine of the present invention is free from vibrations, noises, and friction losses caused by the piston slap.

Further, in the piston engine of the present invention, the rotor is provided with a pair of the balanced connecting rods to impart half the rotor's rocking power to each of a pair of the balanced crank shafts each of which converts the half of the rocking power to a piece of torque on its axis of rotation. Consequently, the piston engine of the present invention is completely balanced in reciprocating mass or inertia, and, therefore free from any vibrations and noises caused by an unbalanced mass or inertia.

Further, in the case of the internal combustion engine according to the present invention, since any torque produced during the piston strokes (i.e., combustion, exhaust, intake, and compression) of the engine appears in the same plane, there is no fear that the rotor is subjected to a torsional stress. Further, in the piston engine of the present invention, power transmission from the pair of the connecting rods to the corresponding pair of the crank shafts is performed on the same plane, which prevents the individual crank shafts from being subjected to any harmful couples of forces.

Furthermore, in the engine of the present invention, since the crank shaft is downsized in its turning radius, the crank pin may overlap in cross section with the crank shaft in more area than before, which may strengthen the individual crank shafts in stiffness, and permit both the crank pins and the crank shafts to be reduced in diameter. Further, when the present invention is applied to a four-cylinder single-acting four-cycle reciprocating piston engine, the number of the connecting rods is reduced to two. Incidentally, the corresponding conventional four-cylinder single-acting four-cycle reciprocating piston engine requires four connecting rods. Such considerable reduction in the number of the connecting rods means that the engine of the present invention may reduce its friction loss to a considerable extent.

Preferably, in the piston engine of the present invention having the above construction, the gear mechanism comprises:

a pair of first spur gears each fixedly mounted on each of the crank shafts; and a second spur gear fixedly mounted on the output shaft and meshed with both the first spur gears.

Further, preferably, the above gear mechanism comprises:

a pair of first bevel gears each fixedly mounted on each of the crank shafts; and a second bevel gear fixedly mounted on the output shaft and meshed with both the first bevel gears.

Preferably, in the piston engine of the present invention having the above construction:

the rotor is provided with a dovetail groove;

the piston is provided with a rotor-mounted end portion assuming a wedge shape, and has the rotor-mounted end portion inserted in the dovetail groove of the rotor;

whereby the piston is fixedly mounted on the rotor.

Further, preferably: the rotor is provided with a dovetail groove; the piston is provided with a rotor-mounted end portion assuming a wedge shape, and has the rotor-mounted end portion inserted in the dovetail groove of the rotor, a pair of the pistons being diametrically opposed to each other with respect to the center of the rotor; the rotor-mounted end portion assuming the wedge shape of the piston is provided with a circularly-curved wall portion; and, a compression ring is disposed radially inwardly between the circularly-curved wall portions of the pair of the pistons to urge the wall portions radially outwardly.

Preferably, in the piston engine of the present invention:

the rotor is provided with a dovetail groove;

the piston is provided with a rotor-mounted end portion assuming a wedge shape, and has the rotor-mounted end portion inserted in the dovetail groove of the rotor, a pair of the pistons being diametrically opposed to each other with respect to the center of the rotor;

the rotor-mounted end portion assuming the wedge shape of the piston is provided with a circularly-curved wall portion;

a compression ring is disposed radially inwardly between the circularly-curved wall portions of the pair of the pistons to urge the wall portions radially outwardly; and a plurality of piston rings are embedded in an outer surface of the piston so as to be oppositely disposed to an inner surface of the cylinder.

Further, preferably: the rotor is provided with a dovetail groove; the piston is provided with a rotor-mounted end portion assuming a wedge shape, and has the rotor-mounted end portion inserted in the dovetail groove of the rotor, a pair of the pistons being diametrically opposed to each other with respect to the center of the rotor; the rotor-mounted end portion assuming the wedge shape of the piston is provided with a circularly-curved wall portion; a compression ring is disposed radially inwardly between the circularly-curved wall portions of the pair of the pistons to urge the wall portions radially outwardly; a plurality of piston rings are embedded in an outer surface of the piston so as to be oppositely disposed to an inner surface of the cylinder; the rotor is provided with an upper and a lower flange portion in its upper and its lower surface, respectively, the flange portions being coaxially arranged with the circularly-curved wall porions of the pistons; and, each of an upper and a lower rotor ring is radially outwardly disposed to encircle each of the upper and the lower flange portion of the rotor and each of the circularly-curved wall portions of the pistons.

Still further, preferably, in the piston engine of the present invention:

the rotor is provided with a dovetail groove;

the piston is provided with a rotor-mounted end portion assuming a wedge shape, and has the rotor-mounted end portion inserted in the dovetail groove of the rotor, a pair of the pistons being diametrically opposed to each other with respect to the center of the rotor;

the rotor-mounted end portion assuming the wedge shape of the piston is provided with a circularly-curved wall portion;

a compression ring is disposed radially inwardly between the circularly-curved wall portions of the pair of the pistons to urge the wall portions radially outwardly;

a plurality of piston rings are embedded in an outer surface of the piston so as to be oppositely disposed to an inner surface of the cylinder;

the rotor is provided with an upper and a lower flange portion in its upper and its lower surface, respectively, the flange portions being coaxially arranged with the circularly-curved wall portions of the pistons;

each of an upper and a lower rotor ring is radially outwardly disposed so as to encircle each of the upper and the lower flange portion of the rotor and each of the circularly-curved wall portions of the pistons; and a pressure oil supplied to the interior of the rotor is introduced into the interior of the piston to cool both the rotor and the piston.

Preferably, the pressure oil supplied to the interior of the rotor is introduced into the interior of the piston to lubricate both the piston rings and the rotor ring.

In the piston engine of the present invention having the above construction: there is no fear that the piston is subjected to a considerable lateral pressure; a pair of the connecting rods are employed; both the crank pins and the crank shafts are downsized; and, any counter weight is not employed, which makes it possible to save the oil agitation power of the engine, and, therefore to considerably improve the engine in machine efficiency. Further, in the piston engine of the present invention having the above construction: any vibration and noise caused by unbalanced mass or inertia of the engine components and those caused by couples of forces of the engine components are removed, which makes it possible to drastically reduce the torsional vibrations of the crank shafts.

Further, in the piston engine of the present invention having the above construction, it is possible to reduce the reciprocating masses of the circularly-curved cylindrical pistons and like engine components up to less than a quarter of those of the conventional reciprocating pistons and like conventional engine components. Consequently, it is possible for the piston engine of the present invention to considerably improve its engine performance. Further, since the piston engine of the present invention is of a double-acting type, it is possible for the piston engine of the present invention to reduce in size to a third of the conventional piston engine, which makes it possible for the engine of the present invention to be compact and lightweight, and further low in manufacturing cost.

The above makes it possible for the piston engine of the present invention to reduce its materials required in manufacturing, and thereby considerably reducing the power consumption in its production plant. Further, as for the internal combustion engine of the present invention, it is possible to considerably reduce the fuel consumption of the engine, and, thereby considerably reducing the amount of $CO_2$ emitted from the engine.

DETAILED DESCRIPTION OF THE PREFERRED EMBODIMENTS

Now, best modes of the present invention will be described in detail with reference to the accompanying drawings.

Figure 3:
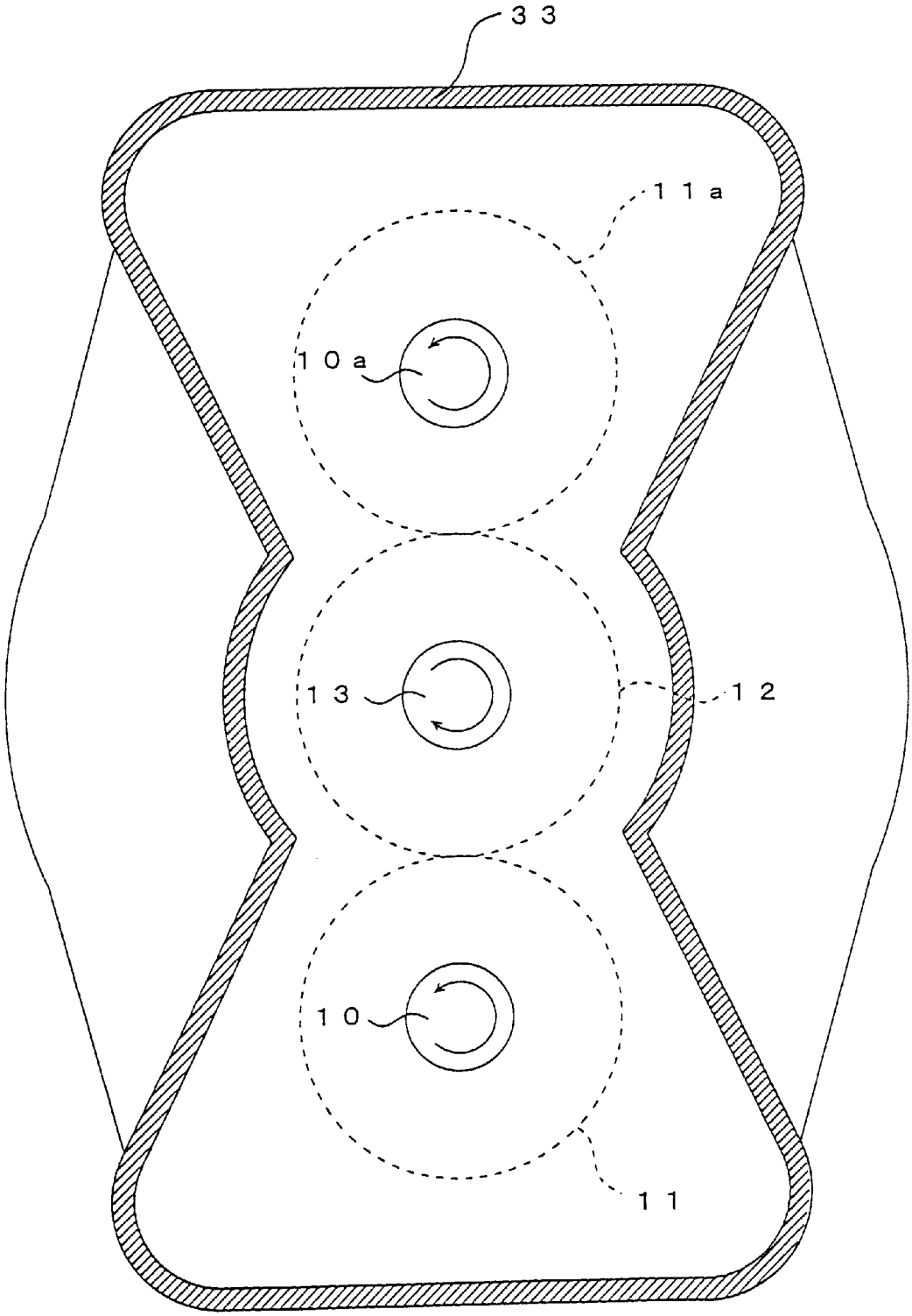
FIG. 3 is a longitudinal sectional view of an oil pan portion of the piston engine of the present invention shown in FIG. 1.
Figure 4:
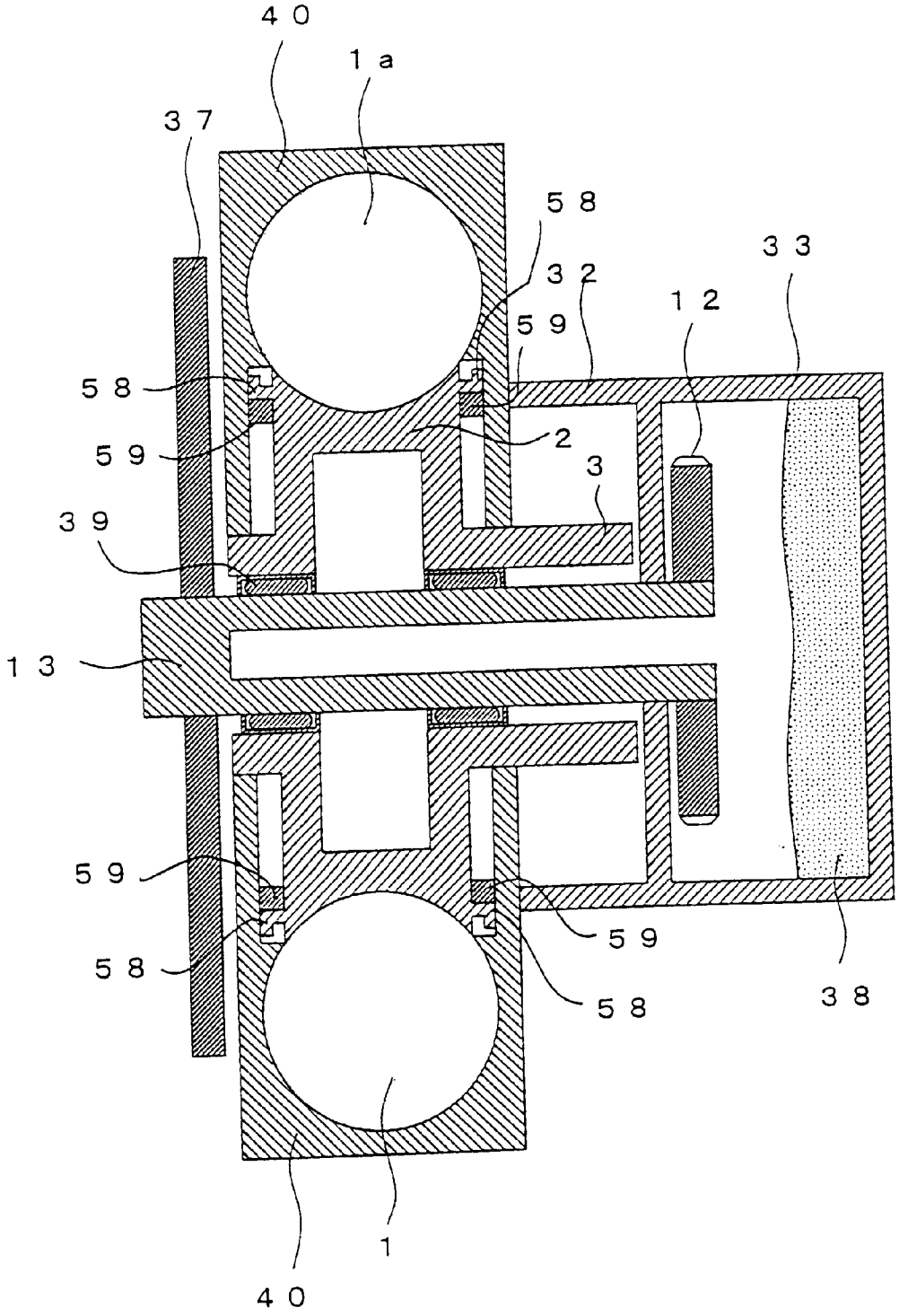
FIG. 4 is a cross-sectional view of the piston engine of the present invention, taken along the line A—A of FIG. 1.
Figure 5:
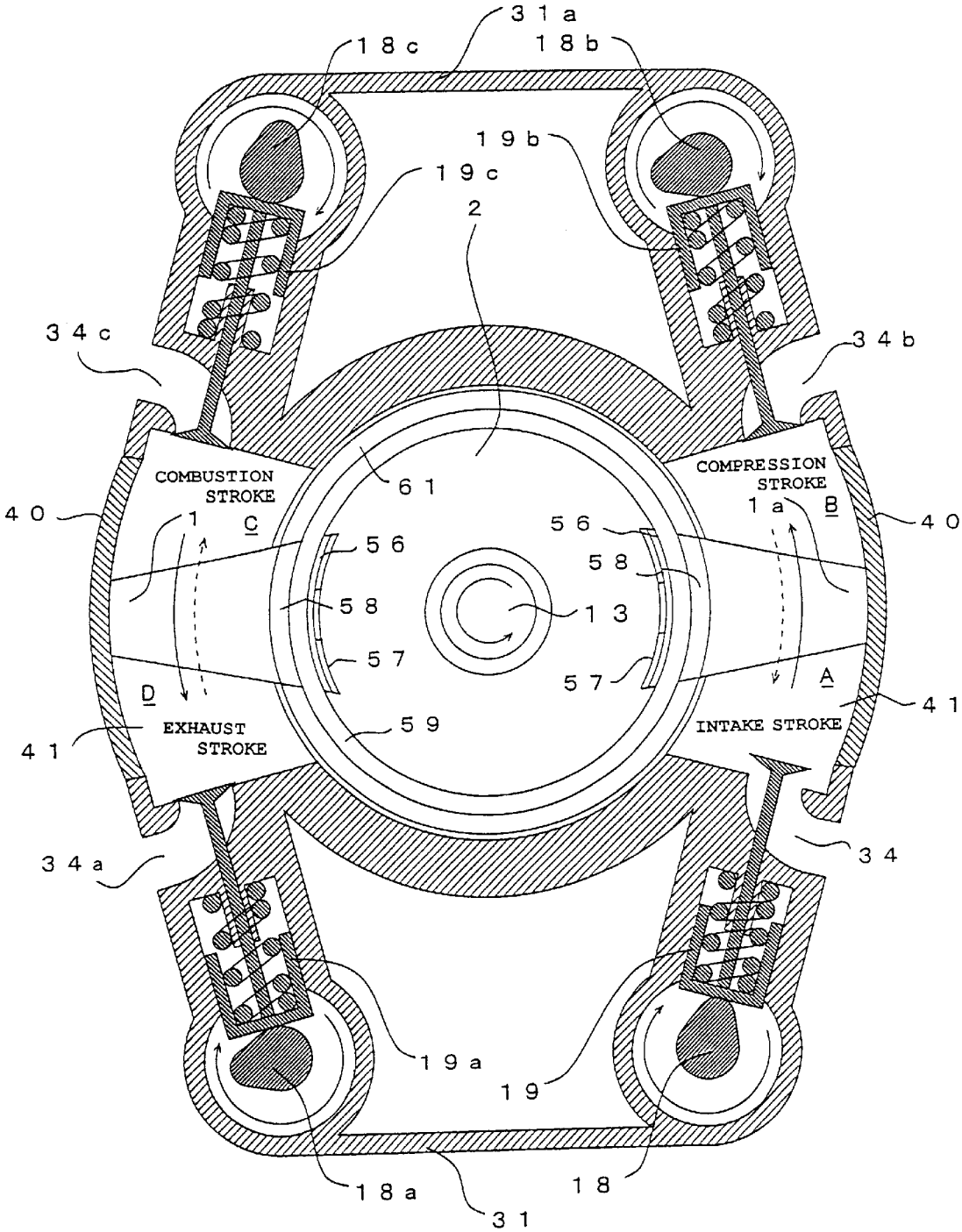
FIG. 5 is a longitudinal sectional view of a cylinder head portion of the piston engine of the present invention shown in FIG. 1, illustrating an intake valve mechanism of the engine.

FIGS. 1 to 11 show a first embodiment of a circularly-curved piston engine of the present invention. As shown in FIG. 5, the first embodiment is of a reciprocating or rocking-action piston engine provided with a pair of circularly-curved pistons 1, 1*a*. The engine of the first embodiment of the present invention shown is a two-cylinder four-cycle engine, which corresponds to a conventional four-cylinder four-cycle engine. As is clear from FIG. 5, the engine of the first embodiment is a double-acting engine provided with a pair of combustion chambers, which are symmetrically arranged about an axis of rotation of a rotor 2. As for the fuel system and the ignition system of the engine of the first embodiment, there is substantially no difference between the present invention and the prior art.

In the engine of the present invention, the rocking-action cylindrical pistons 1, 1*a* are fixedly mounted on the rotor 2. More specifically, each of these pistons 1, 1*a* has its rotor-mounted end portion 56 formed into a wedge shape in plan view, as is clear from FIG. 5. In other words, the rotor 2 has each of its piston-mounting portions formed into a dovetail groove 57 corresponding to the wedge portion 56 of each of the pistons 1, 1*a*. In assembly operations, as is clear from FIGS. 5 and 7, the rotor-mounted end portion (hereinafter referred to as the wedge portion) 56 of each of the pistons 1, 1*a* is inserted into each of the dovetail grooves 57 of the rotor 2 in a direction perpendicular to the plane of the rotor 2, so that the pistons 1, 1*a* are mounted in the corresponding dovetail grooves 57 of the rotor 2.

Figure 7:
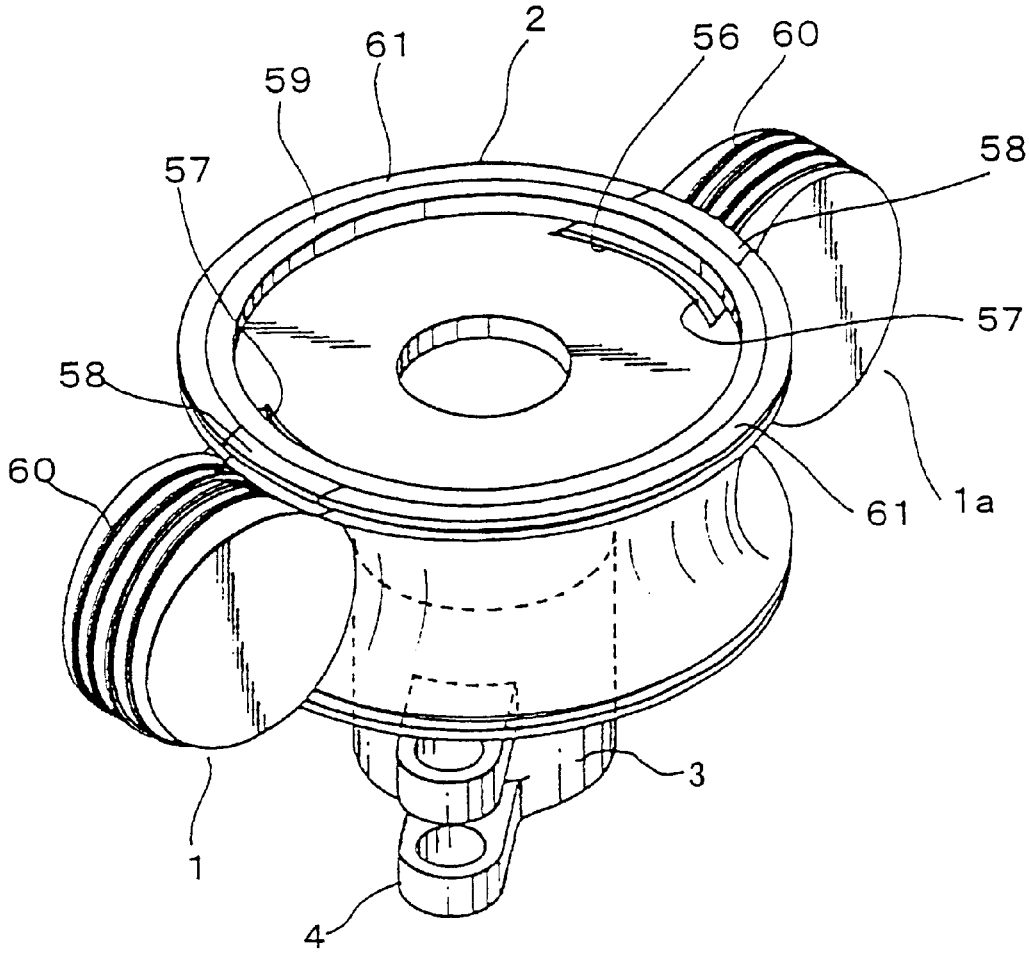
FIG. 7 is a perspective view of the piston engine of the present invention, illustrating the rotor and the circularly-curved cylindrical pistons of the engine shown in FIG. 1.
Figure 8:
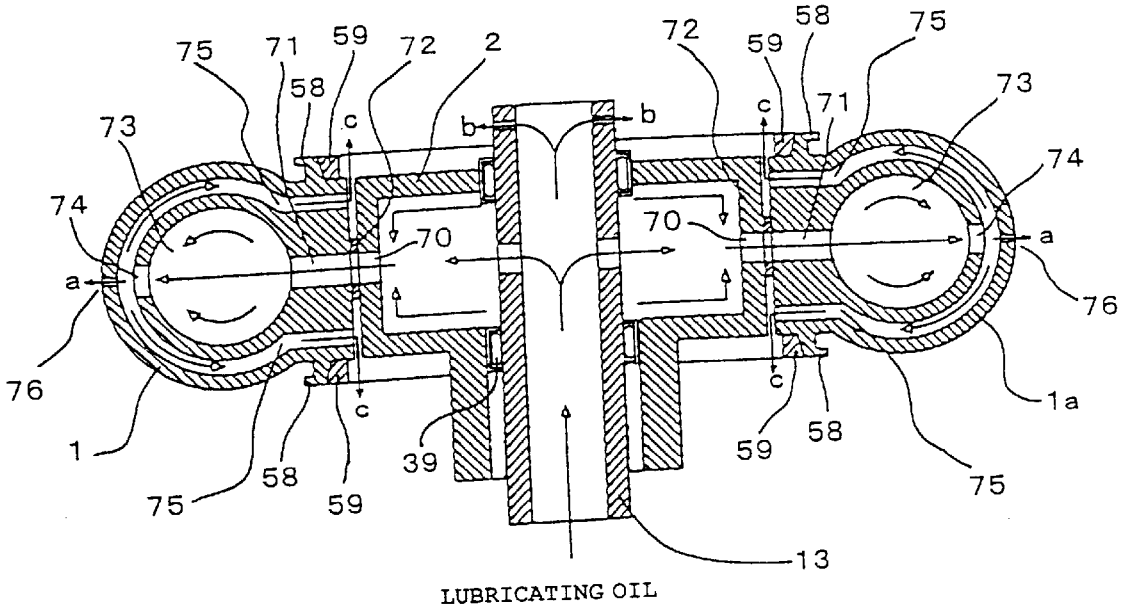
FIG. 8 is a sectional view of the piston engine of the present invention, illustrating flow of oil to the moving parts of the engine shown in FIG. 1.

After the above assembly operations, as shown in FIGS. 7 and 8, a pair of compression rings 59 are mounted on an upper and a lower surface of the rotor 2 in a manner such that each of the compression ring 59 resiliently urges each of the pistons 1, 1*a* radially outwardly through a circularly-curved wall portion 58 of each of the pistons 1, 1*a*. A pair of the wall portions 58 are formed in an upper and a lower surface of the wedge portion 56 of each of the pistons 1, 1*a*. Since the pistons 1, 1*a* are urged and held by these compression rings 59, it is possible to prevent the pistons 1, 1*a* from dropping out of the dovetail grooves 57 of the rotor 2, as shown in FIGS. 7 and 8.

A plurality of piston rings 60 are embedded in an outer peripheral surface of each of the pistons 1, 1*a*, and brought into slidable contact with an inner peripheral surface of each of a pair of circularly-curved cylinder portions 41 of a cylinder block 40. These cylinder portions 41 of the cylinder block 40 are symmetrically arranged about the axis of rotation of the rotor 2 which is provided with an upper and a lower flange portions 61. As is clear from FIG. 7, the upper and the lower flange portion 61 of the rotor 2 are coaxially arranged with the upper and the lower wall portion 58 of each of the pistons 1, 1*a*, respectively.

Figure 10:
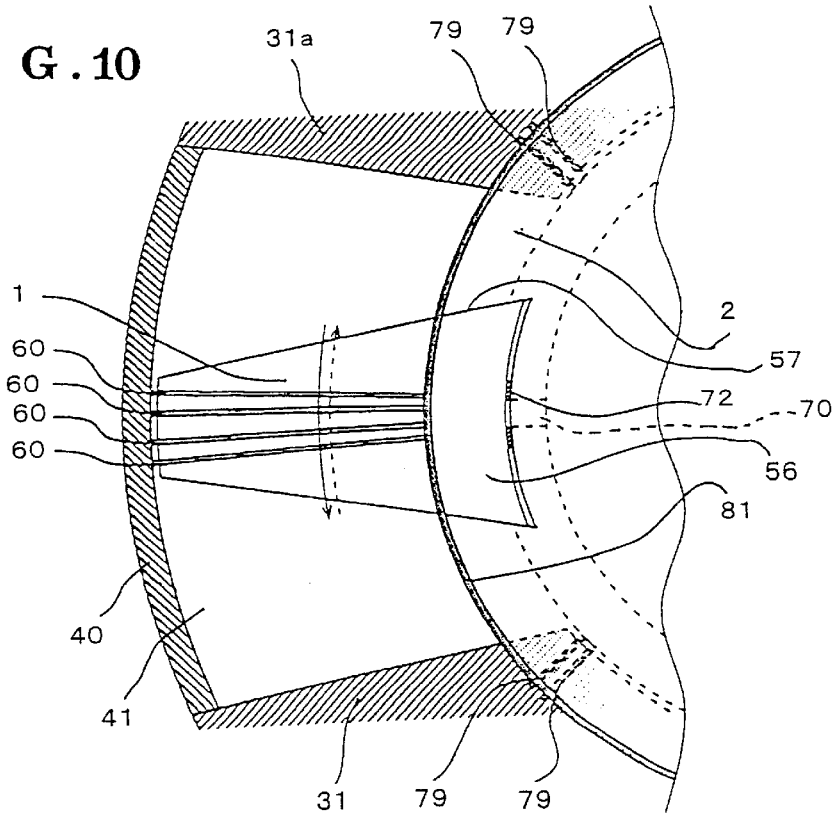
FIG. 10 is a sectional view of the piston engine of the present invention, illustrating a sealing mechanism of the engine shown in FIG. 1.

As shown in FIG. 10, an oil passage 70 (shown in dotted line) is formed in the bottom of the dovetail groove 57 of the rotor 2, and communicates with another oil passage 71 formed in the radially innermost end surface of the wedge portion 56 of each of the pistons 1, 1*a*. In order to prevent a lubricating oil from leaking out of the engine through a clearance between the wedge portion of each of the piston 1, 1*a* and the bottom of each of the dovetail grooves 57 of the rotor 2, as shown in FIGS. 8 and 10, an oil seal 72 is interposed between the radially innermost end surface of the wedge portion 56 of each of the pistons 1, 1*a* and the bottom of each of the dovetail grooves 57 of the rotor 2.

As shown in FIG. 8, in the interior of each of the pistons 1, 1*a*, there is provided an oil chamber 73, to which the oil passage 71 opens. Further, formed in the interior of each of the pistons 1, 1*a* are: an outlet opening 74 through which the lubricating oil received in the oil chamber 73 flows out of the chamber 73; a return passage 75 through which the lubricating oil passed through the outlet opening 74 returns to the oil pan portion 33 of the crank case 32 (shown in FIG. 4); and, a discharge opening 76 through which a part of the lubricating oil passing through the return passage 75 is supplied to from the interior of each of the pistons 1, 1*a* to an outer peripheral surface of each of the pistons 1, 1*a*.

As described above, the rocking-motion cylindrical pistons 1, 1*a* are mounted on the rotor 2, and firmly and resiliently held by the compression rings 59 on the rotor 2. Consequently, it is possible for the compression rings 59 to absorb any physical stresses acting on the pistons 1, 1*a*, and absorb also any thermal stresses acting on both the rotor 2 and the pistons 1, 1*a*.

As shown in FIG. 4, the rotor 2 is rotatably supported on its central rocking axle portion 3 by a power output shaft 13. This rocking axle portion 3 of the rotor 2 is driven by the pistons 1, 1*a* so as to rotate alternately clockwise and counterclockwise, i.e., to rock on its axis of rotation. As is clear from FIG. 4, the rotor 2 including its axle portion 3 is symmentrically formed with respect to the axis of rotation of the rotor 2 so as to be balanced in shape and mass about the axis of rotation of the rotor 2.

Figure 1:
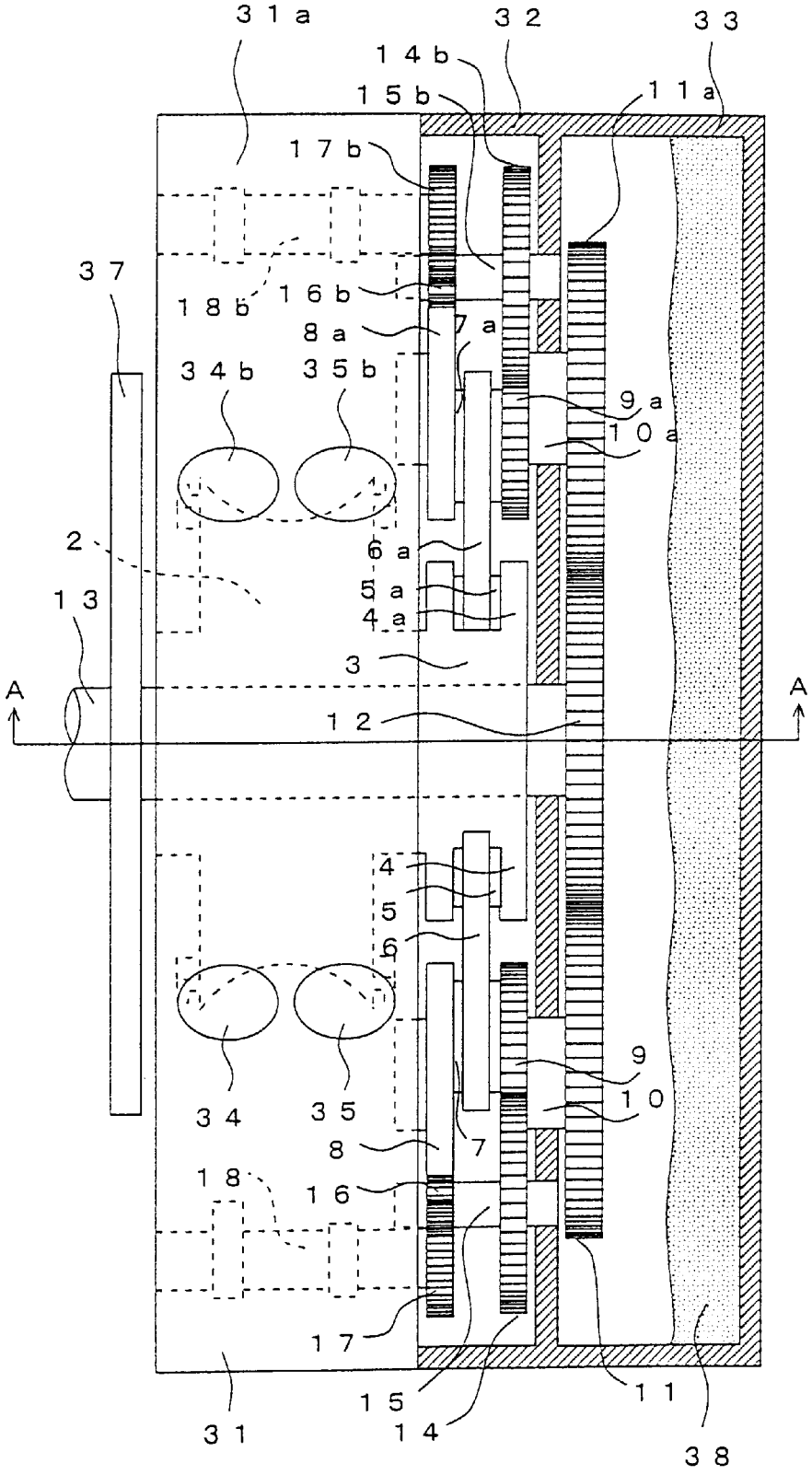
FIG. 1 is a partially broken front view of the circularly-curved piston engine of the present invention.
Figure 2:
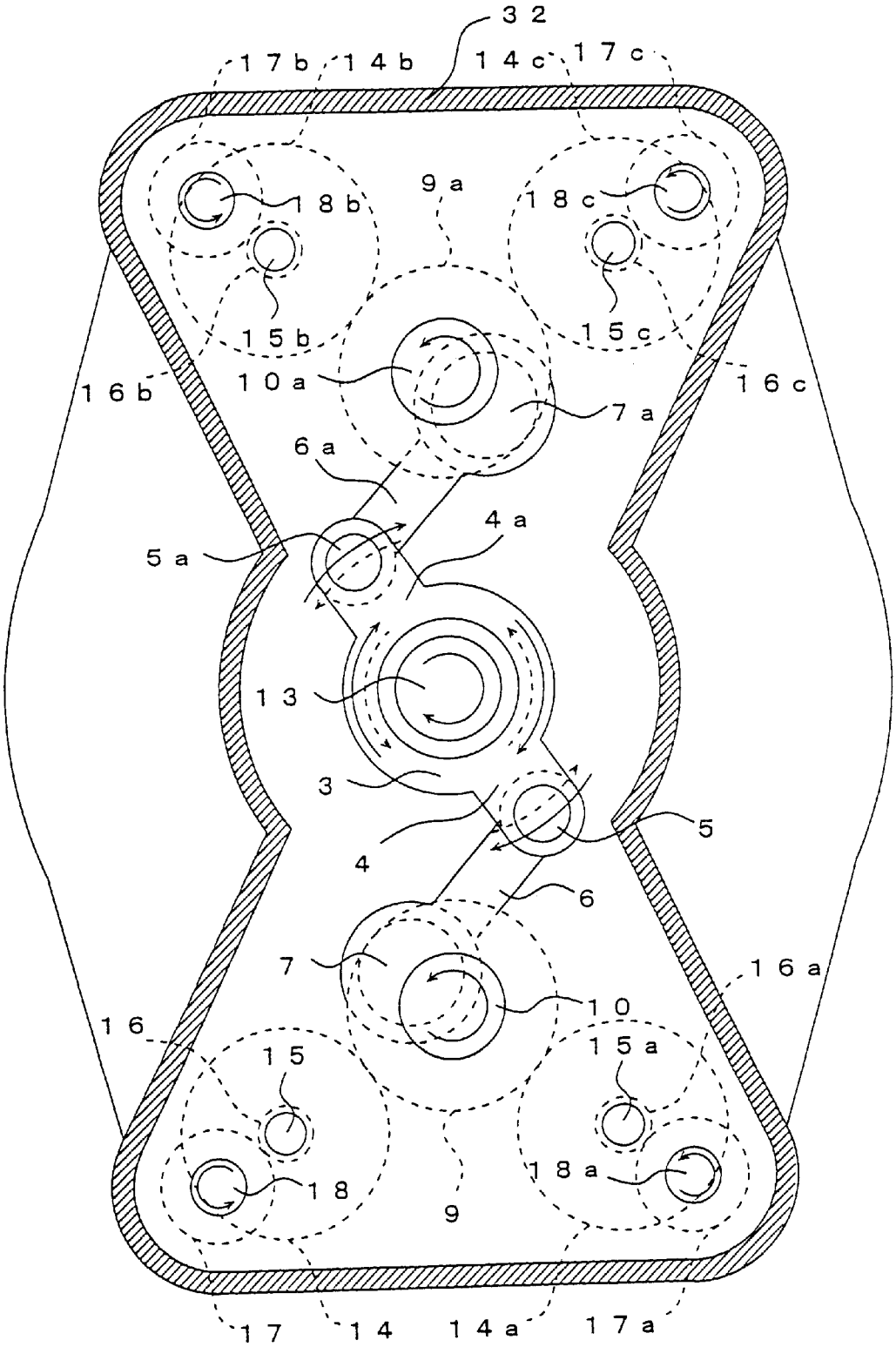
FIG. 2 is a longitudinal sectional view of a crank case of the piston engine of the present invention shown in FIG. 1.

As shown in FIGS. 2 and 7, the rocking axle portion 3 of the rotor 2 is provided with a pair of integral rocking arm portions 4, 4*a*, which are symmetrically or diametrically opposed to each other with respect to the axis of rotation of the rotor 2. As is clear from FIGS. 1 and 2, rotatably mounted on an end portion of each of the rocking arm portions 4, 4*a* is one of the opposite end portions of each of connecting rods 5, 5*a*. There is no difference in turning radius between the rocking arm portions 4 and 4*a* of the rotor 2. Further, as for the connecting rods 6, 6*a*, there is no difference in mass and shape therebetween.

Each of the connecting rods 6, 6*a* has the other end portion thereof rotatably connected with each of a pair of crank pins 7, 7*a* (shown in dotted line in FIG. 2). As is clear from FIG. 1, the crank pin 7 has its opposite end portions rotatably mounted on both a disc crank 8 and a disk crank gear 9 in their off-center bore portions. The crank pin 7*a* also has its opposite end portions rotatably mounted on both a disc crank 8*a* and a disc crank gear 9*a* in their off-center bore portions. Both the disc cranks 8, 8*a* and the disc crank gears 9, 9*a* are symmetrically arranged with respect to the axis of rotation of the rotor 2. As is clear from the above description, the connecting rod 6 has the other end portion thereof rotatably connected with both the disc crank 8 and the disc crank gear 9 through the crank pin 7 in the off-center portion of each of the disc crank 8 and the disc crank gear 9. The connecting rod 6*a* also has the other end portion thereof rotatably connected with both the disc crank 8*a* and the disc crank gear 9*a* through the crank pin 7*a* in the off-center portion of each of the disc crank 8*a* and the disc crank gear 9*a*.

The disc cranks 8, 8*a* and the disc crank gears 9, 9*a* are rotatably supported on their central portions through a pair of crank shafts 10, 10*a,* respectively. As a result, power produced in the pistons 1, 1*a* is divided into two parts, each of which is transmitted to each of the crank shafts 10, 10*a* to rotatably drive the same. Fixedly mounted on the crank shafts 10, 10*a* are a pair of drive gears 11, 11*a,* respectively. These drive gears 11, 11*a* are symmetrically arranged with respect to the axis of rotation of the rotor 2, and meshed with a common driven gear 12 to rotatably drive the same, as shown in FIGS. 1 and 3.

Figure 9:
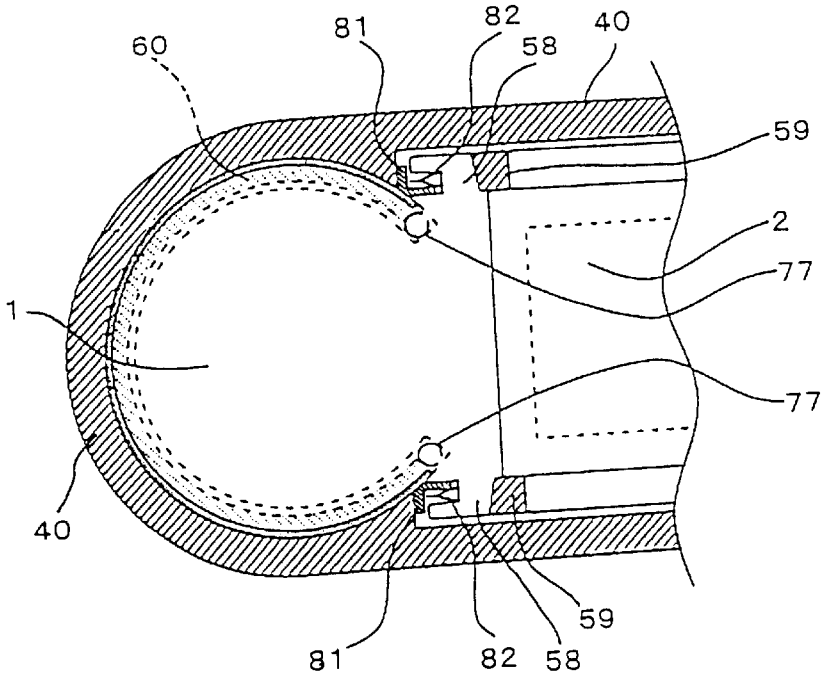
FIG. 9 is a sectional view of an essential part of the piston engine of the present invention, illustrating the piston ring used in the engine shown in FIG. 1.

As shown in FIG. 9, each of the piston rings 60 mounted on each of the pistons 1, 1*a* has its opposite end portions completely embedded in each of the pistons 1, 1*a,* and constantly urged radially outwardly by its back-up or expander ring 77 in a manner such that the piston ring 60 is brought into close contact with the inner peripheral surface of each of the circularly-curved cylinder portions 41 of the cylinder block 40. On the other hand, as shown in FIGS. 10 and 11, at least one cylinder head ring 79 is embedded in a portion of each of cylinder heads 31, 31*a,* which portion abuts against a curved concave outer peripheral surface of the rotor 2.

Figure 11:
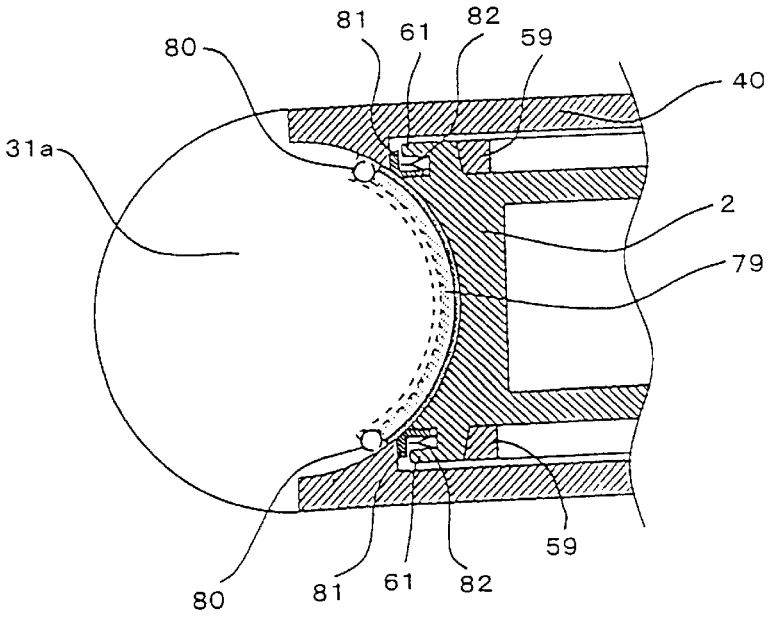
FIG. 11 is a sectional view of the piston engine of the present invention, substantially illustrating the cylinder-head ring portion of the engine shown in FIG. 1.

As is in the case of the piston rings 60, as shown in FIG. 11, the cylinder head ring 79 is constantly urged radially outwardly by its back-up or expander ring 80, which is embedded in the opposite end portions of the cylinder head ring 79, so that the cylinder head ring 79 is brought into close contact with the curved concave outer peripheral surface of the rotor 2, whereby each of the pistons 1, 1*a* has its opposite side combustion chambers hermetically sealed.

As shown in FIGS. 10 and 11, an upper and a lower rotor ring 81 each having an L-shaped cross section are mounted on both the flange portions 61 of the rotor 2 and the circularly-curved wall portions 58 of the pistons 1, 1*a* in a manner such that these flange portions 61 and the wall portions 58 are encircled by the rotor ring 81 in the upper and the lower side of the rotor 2. In each of the upper and the lower side of the rotor 1, a compression spring 82 is interposed between: the rotor ring 81; and, the flange portions 61 and the wall portions 58, so that the rotor ring 81 is brought into resilient contact with the rotor 2. In addition to the above, due to its expanding properties, it is possible for the rotor ring 81 to be brought into close contact with an inner peripheral wall of the cylinder block 40 by itself.

In FIG. 8: the reference letter "a" denotes a passage of lubricating oil for lubricating the piston rings 60; the reference letter "b" denotes a passage of lubricating oil for lubricating the cylinder head rings 79; and, the reference letter "c" denotes a passage of lubricating oil for lubricating the rotor rings 81.

As shown in FIG. 8, the lubricating oil fed under pressure to the interior of the power output shaft 13 passes through the oil passages 70, 71 to enter the interior of each of the rocking-motion cylindrical pistons 1, 1*a,* and passes through the outlet opening 74 to enter the oil return passage 75, and is then recovered therefrom. When the lubricating oil passes through the above lubrication route as described above, both the rotor 2 and the pistons 1, 1*a* are cooled by this lubricating oil.

Figure 6:
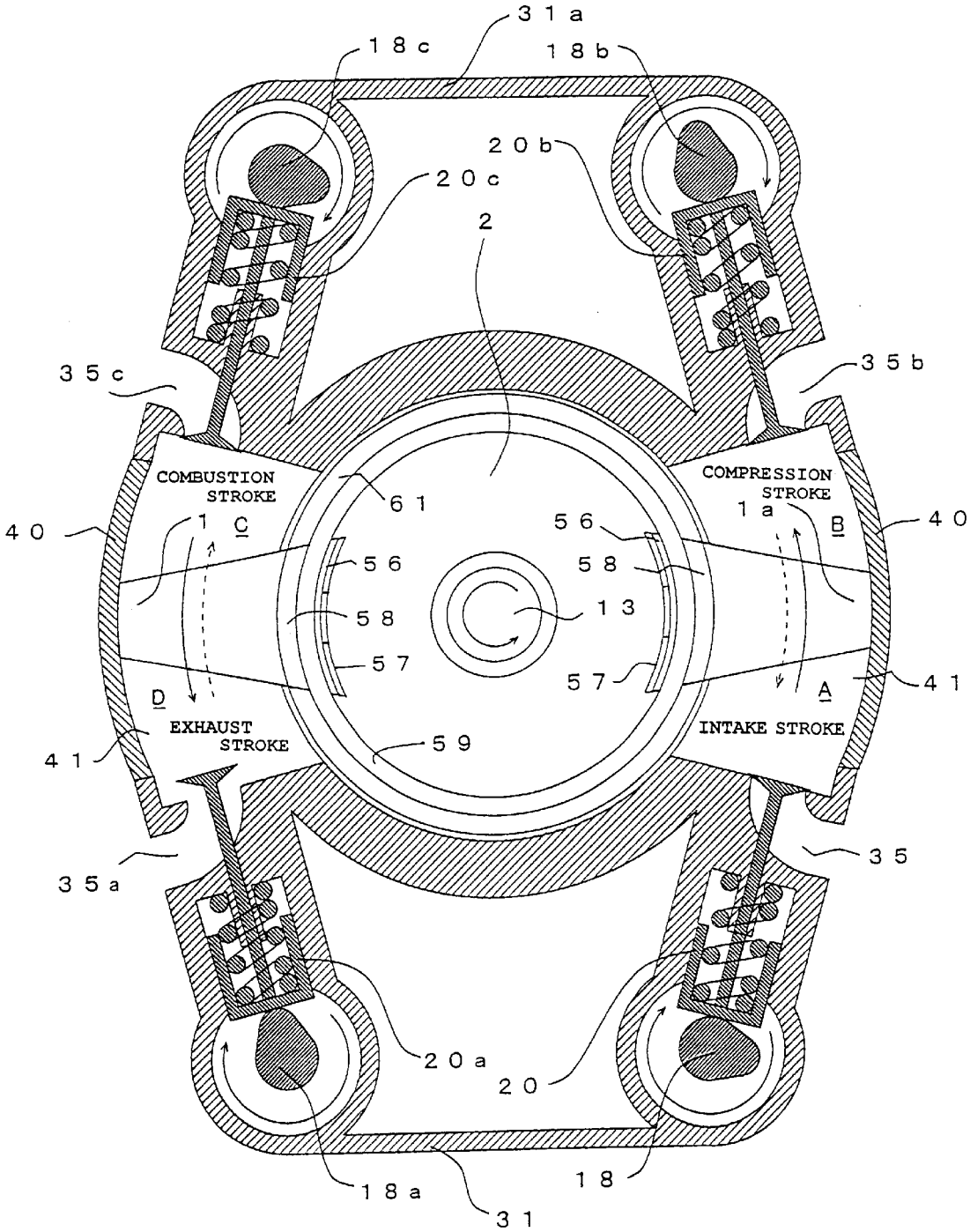
FIG. 6 is a longitudinal sectional view of a cylinder head portion of the piston engine of the present invention shown in FIG. 1, illustrating an exhaust valve mechanism of the engine.

In an internal combustion piston engine to which the present invention is applied, as is clear from FIG. 2, the disc crank gears 9 and 9*a* are meshed with: a pair of disc crank driven gears 14, 14*a;* and, a pair of disc crank driven gears 14*b,* 14*c,* respectively, to rotatably drive these disc crank driven gears 14, 14*a,* 14*b* and 14*c*. These disc crank driven gears 14, 14*a,* 14*b* and 14*c* are rotatably supported or mounted on cam link shafts 15, 15*a,* 15*b* and 15*c,* respectively, in their central portions. Then, cam shaft drive gears 16, 16*a,* 16*b* and 16*c* are fixedly mounted on the cam link shafts 15, 15*a,* 15*b* and 15*c,* respectively, and meshed with cam shaft driven gears 17, 17*a,* 17*b* and 17*c,* respectively. These cam shaft driven gears 17, 17*a,* 17*b* and 17*c* are fixedly mounted on cam shafts 18, 18*a,* 18*b* and 18*c,* respectively. Due to the above mechanism, the cam shaft driven gears 17, 17*a,* 17*b* and 17*c* are driven when the engine of the present invention is in operation, so that an intake valve mechanism 19, 19*a,* 19*b* and 19*c* and an exhaust valve mechanism 20, 20*a,* 20*b* and 20*c* are operated, as shown in FIGS. 5 and 6. In operation, each of the cam shafts 18, 18*a,* 18*b* and 18*c* is set in rotational speed at a value substantially equal to half a value of the power output shaft 13.

The above mechanism is incorporated in the assembly constructed of: the cylinder heads 31, 31*a;* and the crank case 32 provided with the oil pan portion 33. As is clear from FIG. 1, the cylinder heads 31, 31*a* are provided with four intake ports 34, 34*a,* 34*b* and 34*c* and four exhaust ports 35, 35*a,* 35*b* and 35*c*. The intake ports 34, 34*a,* 34*b* and 34*c* are combined with an intake valve mechanism 19, 19*a,* 19*b* and 19*c*. On the other hand, the exhaust ports 35, 35*a,* 35*b* and 35*c* are combined with an exhaust valve mechanism 20, 20*a,* 20*b* and 20*c*. When the engine of the present invention is in operation so that the cam shafts 18, 18*a,* 18*b* and 18*c* are rotatably driven, the intake valve mechanism 19, 19*a,* 19*b* and 19*c* and the exhaust valve mechanism 20, 20*a,* 20*b* and 20*c* periodically and alternately open and close the intake ports 34, 34*a,* 34*b* and 34*c* and the exhaust ports 35, 35*a,* 35*b* and 35*c*.

In FIGS. 5 and 6, a combustion chamber "A" is in the intake stroke of the engine, so that the intake port 34 is opened and the exhaust port 35 is closed. On the other hand, another combustion chamber "B" is in the compression stroke of the engine, so that both the intake port 34*b* and the exhaust port 35*b* are closed. Further another combustion chamber "C" is in the combustion stroke of the engine, so that both the intake port 34*c* and the exhaust port 35*c* are closed. Still further anther combustion chamber "D" is in the exhaust stroke of the engine, so that the intake port 34*a* is closed and the exhaust port 35*a* is opened. Due to the above operation of the valve mechanisms, the rotor 2 is rotatably driven in a direction of the arrow shown in solid line in FIG. 5, i.e., rotates counterclockwise on the axis of rotation of the rotor 2.

Incidentally, in FIGS. 1 and 4: the reference numeral 37 denotes a flywheel; the reference numeral 38 denotes the lubricating oil received in the oil pan portion 33 of the crank case 32; and, the reference numeral 39 denotes a bearing for rotatably supporting the rotor 2.

In operation, the pistons 1, 1*a* rock in opposite directions on the axis of rotation of the rotor 2, which causes the rotor 2 to rock on the axis of rotation of the rotor 2. As a result, the rocking motion of the central rocking axle portion 3 of the rotor 2 is transmitted to its integral rocking arm portions 4, 4*a,* and further to the connecting rods 6, 6*a,* through which the torque is further transmitted to the disc cranks 8, 8*a* and the disc crank gears 9, 9*a,* whereby the thus transmitted rocking motion is eventually converted into rotational motion of the disc crank gears 9, 9*a*. The individual pieces of torque of these gears 9, 9*a* are further transmitted to the drive gears 11, 11*a,* and the singe common driven gear 12 in which the individual pieces of the thus transmitted torque are combined into one piece of torque which is received by the power output shaft 13, so that the power output shaft 13 is rotatably driven.

In addition to the above, the disc crank gears 9, 9*a* rotatably drive the disc crank driven gears 14, 14*a,* 14*b* and 14*c,* which results in rotation of each of the cam shafts 15, 15*a,* 15*b* and 15*c,* and, therefore results in rotation of each of the cam shaft drive gears 16, 16*a,* 16*b* and 16*c* which are fixedly mounted on the cam shafts 15, 15*a,* 15*b* and 15*c,* respectively. Consequently, as is clear from FIG. 2, the cam shaft driven gears 17, 17*a,* 17*b* and 17*c* fixedly mounted on the cam shafts 18, 18*a,* 18*b* and 18*c,* respectively, are rotatably driven by the cam shaft drive gears 16, 16*a,* 16*b* and 16*c,* respectively. Due to this, the intake valve mechanism 19, 19*a,* 19*b* and 19*c* and the exhaust valve mechanism 20, 20*a,* 20*b* and 20*c* are operated to control the combustion, exhaust, intake, and the compression stroke of the engine of the present invention.

In the above operations, there is no fear that the rocking-motion cylindrical pistons 1, 1*a* are subjected to side pressure. Due to this, any vibration, noise and friction loss all caused by the side pressure is eliminated in the engine of the present invention, which considerably improves the engine of the present invention in mechanical efficiency.

Further, in the engine of the present invention, no unbalance motion is found in any of the pistons 1, 1*a* and the rotor 2. In converting the rocking motion of the rotor 2 into a rotational motion of each of the disc crank 8, 8*a* and the disc crank gears 9, 9*a,* the rocking motion of the central rocking axle portion 3 of the rotor 2 is transmitted to the crank shafts 10 and 10*a* through the connecting rods 6 and 6*a,* respectively, and further to the drive gears 11, 11*a* and the driven gears 12, through which finally to the power output shaft 13. Consequently, any mass or inertia is completely balanced in the engine of the present invention. In other words, any vibrations and noises caused by unbalanced mass or inertia is completely eliminated in the engine of the present invention.

In addition to the above, since any torque appearing in the combustion, exhaust, intake, and the compression stroke of the engine appears in the same plane, it is possible for the rotor 2 to be free from any torsional stress. Further, power transmission from the connecting rods 6, 6*a* to the crank shafts 10, 10*a* is accomplished in the same plane in the engine of the present invention, which means that the crank shafts 10, 10*a* are free from any couples of forces.

Furthermore, the engine of the present invention permits the crank shafts 10, 10*a* to be reduced in turning radius, which means that the crank pins 7, 7*a* may overlap with the crank shafts 10, 10*a,* respectively, in larger areas in cross section than before, and, therefore may be increased in stiffness. Such increase of stiffness permits both the crank pins 7, 7*a* and the crank shafts 10, 10*a* to be downsized in diameter. Further, in the engine of the present invention, the number of the connecting rods 6, 6*a* is two, which permits the engine of the present invention to reduce its friction loss to a considerable extent.

Due to the above construction and actions, in the engine of the present invention, there is no fear that the pistons 1, 1*a* suffer from the side pressure. Further, in the engine of the present invention: a pair of the connecting rods 6, 6*a* are employed; both the crank pins 7, 7*a* and the crank shafts 10, 10*a* are downsized in diameter; and, no counter weight is employed, which means that unnecessary agitation of the lubricating oil is eliminated to save power losses. Due to the above, it is possible to improve the engine of the present invention in mechanical efficiency to a considerable extent. Furthermore, the engine of the present invention is free from any vibrations and noises all caused by unbalanced mass or inertia, further free from any vibrations and noises all caused by unnecessary couples of forces, and may reduce torsional vibrations of the crank shafts 10, 10*a* to a considerable extent.

Further, in the engine of the present invention, it is possible to reduce its reciprocating mass or inertia to less than a quarter of that of the conventional reciprocating cylindrical piston engine, and, therefore to improve the engine of the present invention in its power output performance to a considerable extent. Furthermore, since the engine of the present invention is of a double-acting engine, it is possible to downsize the engine of the present invention up to less than a third of the conventional reciprocating internal combustion piston engine, which makes it possible for the engine of the present invention to save its space, weight and manufacturing cost.

Next, a second embodiment of the engine of the present invention will be described with reference to FIG. 12. This second embodiment shown in FIG. 12 has substantially the same construction as that of the first embodiment shown in FIGS. 1 to 11, with the exception of its power output mechanism.

Figure 12:
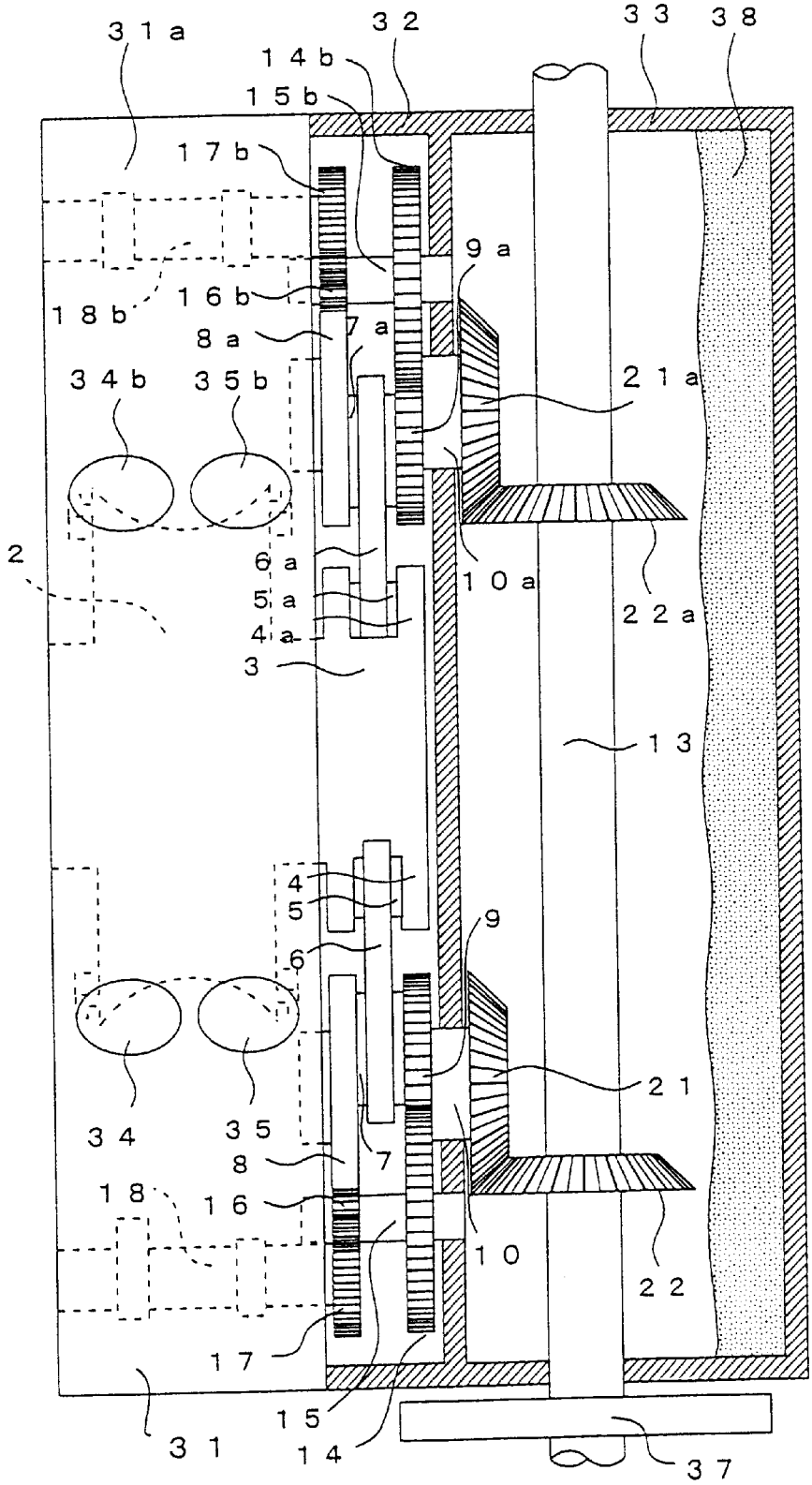
FIG. 12 is a partially broken front view of another embodiment of the circularly-curved piston engine of the present invention.

More specifically, in this second embodiment of the engine of the present invention, as shown in FIG. 12, fixedly mounted on the crank shafts 10, 10*a* are drive bevel gears 21, 21*a* instead of the drive gears 11, 11*a* of the first embodiment shown in FIG. 1. These bevel gears 21 and 21*a* are meshed with driven bevel gears 22 and 22*a,* respectively. Both the driven bevel gears 22, 22*a* are fixedly mounted on the same power output shaft 13, which is rotatably mounted on the oil pan portion 33 of the crank case 32 and rotatably driven by these bevel gears 22, 22*a*. Further, the second embodiment of the engine of the present invention shown in FIG. 12 differs from the first embodiment shown in FIGS. 1 to 11 in: power output process and location of the power output shaft 13; and, mounting position of a flywheel 37 (shown in FIGS. 1 and 12).

As described above, the piston engine of the present invention is applicable to the internal combustion engines, and further to the external combustion engines, reciprocating compressors, hydraulic actuators and the pneumatic actuators, in each of which actuators a pressure oil or a compressed air is alternately supplied to both sides of each of the pistons 1, 1*a*.

This application claims the priority of Japanese Patent application No. Hei 11-170146 filed on Jun. 16, 1999, the disclosure of which is expressly incorporated by reference herein.

What is claimed is:

1. A circularly-curved piston engine comprising:

a plurality of circularly-curved cylinders each assuming a circular shape in cross section;

a plurality of circularly-curved cylindrical pistons each fitting and reciprocating within each of said cylinders;

a rotor carrying said pistons to keep the pistons in balance and rockable about a center of said rotor along orbits relative to said cylinders, wherein said rotor is provided with a pair of connecting rods to impart half a rocking power of said rotor to each of a pair of crank shafts each of which converts the half of said rocking power to a piece or torque on an axis of rotation;

a gear mechanism for receiving a pair of said pieces of torque to combine them into an output power;

an output shaft connected with said gear mechanism for receiving and out-putting said output power;

said rotor being provided with a dovetail groove;

said piston being provided with a rotor-mounted end portion assuming a wedge shape, and has said rotor-mounted end portion inserted in said dovetail groove of said rotor, a pair of said pistons being diametrically opposed to each other with respect to the center of said rotor;

said rotor-mounted end portion assuming said wedge shape of said piston being provided with a circularly-curved wall portion; and a compression ring being disposed radially inwardly between said circularly-curved wall portions of said pair of said pistons to urge said wall portions radially outwardly.

2. The circularly-curved piston engine as set forth in claim 1, wherein said gear mechanism comprises:

a pair of first spur gears each fixedly mounted on each of said crank shafts; and a second spur gear fixedly mounted on said output shaft and meshed with both said first spur gears.

3. The circularly-curved piston engine as set forth in claim 1, wherein said gear mechanism comprises:

a pair of first bevel gears each fixedly mounted on each of said crank shafts; and a second bevel gear fixedly mounted on said output shaft and meshed with both said first bevel gears.

4. The circularly-curved piston engine as set forth in claim 1, wherein:

a plurality of piston rings are embedded in an outer surface of said piston so as to be oppositely disposed to an inner surface of said cylinder.

5. The circularly-curved piston engine as set forth in claim 4, wherein:

said rotor is provided with an upper and a lower flange portion in its upper and its lower surface, respectively, said flange portions being coaxially arranged with said circularly-curved wall portions of said pistons; and each of an upper and a lower rotor ring is radially outwardly disposed to encircle each of said upper and said lower flange portion of said rotor and each of said circularly-curved wall portions of said pistons.

6. The circularly-curved piston engine as set forth in claim 5, wherein:

a pressure oil supplied to the interior of said rotor is introduced into the interior of said piston to cool both said rotor and said piston.

7. The circularly-curved piston engine as set forth in claim 6, wherein:

said pressure oil supplied to the interior of said rotor is introduced into the interior of said piston to lubricate both said piston rings and said rotor ring.

8. The circularly-curved piston engine as set forth in claim 7, wherein:

said piston is fixedly mounted on said rotor.

9. A circularly-curved piston engine comprising:

a plurality of circularly-curved cylinders each assuming a circular shape in cross section;

a plurality of circularly-curved cylindrical pistons each fitting and reciprocating within each of said cylinders;

a rotor carrying said pistons to keep the pistons in balance and rockable about a center of said rotor along orbits relative to said cylinders, wherein said rotor is provided with a pair of connecting rods to impart half a rocking power of said rotor to each of a pair of crank shafts each of which converts the half of said rocking power to a piece or torque on an axis of rotation;

a gear mechanism for receiving a pair of said pieces of torque to combine them into an output power; and an output shaft connected with said gear mechanism for receiving and out-putting said output power;

said rotor is provided with a dovetail groove;

said piston is provided with a rotor-mounted end portion assuming a wedge shape, and has said rotor-mounted end portion inserted in said dovetail groove of said rotor;

whereby said piston is fixedly mounted on said rotor;

a pair of said pistons being diametrically opposed to each other with respect to the center of said rotor;

said rotor-mounted end portion assuming said wedge shape of said piston is provided with a circularly-curved wall portion; and a compression ring is disposed radially inwardly between said circularly-curved wall portions of said pair of said pistons to urge said wall portions radially outwardly.

10. The circularly-curved piston engine as set forth in claim 9, wherein:

a plurality of piston rings are embedded in an outer surface of said piston so as to be oppositely disposed to an inner surface of said cylinder.

11. The circularly-curved piston engine as set forth in claim 10, wherein:

said rotor is provided with an upper and a lower flange portion in its upper and its lower surface, respectively, said flange portions being coaxially arranged with said circularly-curved wall portions of said pistons; and each of an upper and a lower rotor ring is radially outwardly disposed to encircle each of said upper and said lower flange portion of said rotor and each of said circularly-curved wall portions of said pistons.

12. The circularly-curved piston engine as set forth in claim 11, wherein:

a pressure oil supplied to the interior of said rotor is introduced into the interior of said piston to cool both said rotor and said piston.

13. The circularly-curved piston engine as set forth in claim 12, wherein:

said pressure oil supplied to the interior of said rotor is introduced into the interior of said piston to lubricate both said piston rings and said rotor ring.

14. The circularly-curved piston engine as set forth in claim 9, wherein said gear mechanism comprises:

a pair of first spur gears each fixedly mounted on each of said crank shafts; and a second spur gear fixedly mounted on said output shaft and meshed with both said first spur gears.

15. The circularly-curved piston engine as set forth in claim 9, wherein said gear mechanism comprises:

a pair of first bevel gears each fixedly mounted on each of said crank shafts; and a second bevel gear fixedly mounted on said output shaft and meshed with both said first bevel gears.

* * * * *